US007389828B2

(12) United States Patent
Ritter et al.

(10) Patent No.: US 7,389,828 B2
(45) Date of Patent: Jun. 24, 2008

(54) APPARATUS AND METHOD FOR MECHANICAL CALIPER MEASUREMENTS DURING DRILLING AND LOGGING-WHILE-DRILLING OPERATIONS

(75) Inventors: Rene Ritter, Niedersachsen (DE); Hans-Christian Freitag, Kingwood, TX (US); Hans-Juergen Faber, Niedersachsen (DE); James Kinney, New Orleans, LA (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 11/344,291

(22) Filed: Jan. 31, 2006

(65) Prior Publication Data

US 2006/0249307 A1 Nov. 9, 2006

Related U.S. Application Data

(60) Provisional application No. 60/648,486, filed on Jan. 31, 2005.

(51) Int. Cl.
*E21B 47/08* (2006.01)

(52) U.S. Cl. ..... 175/40; 73/152.03; 73/152.46; 181/104

(58) Field of Classification Search ..... 73/152.03, 73/152.46; 181/104; 175/40
See application file for complete search history.

(56) References Cited

U.S. PATENT DOCUMENTS

| | | | | | |
|---|---|---|---|---|---|
| 4,226,116 | A * | 10/1980 | Denison | 73/152.03 |
| 4,247,985 | A | 2/1981 | Boyle et al. | |
| 4,302,881 | A | 12/1981 | Schwind et al. | |
| 4,491,022 | A | 1/1985 | De La Cruz | |
| 4,625,795 | A | 12/1986 | Despax et al. | |
| 4,881,406 | A * | 11/1989 | Coury | 73/152.03 |
| 5,242,020 | A * | 9/1993 | Cobern | 166/254.2 |
| 5,469,736 | A | 11/1995 | Moake | |
| 5,548,900 | A | 8/1996 | Hunt-Grubble | |
| 5,589,825 | A | 12/1996 | Pomerleau | |
| 5,917,774 | A | 6/1999 | Walkow et al. | |
| 6,339,886 | B1 | 1/2002 | Reinhardt | |
| 6,560,889 | B1 | 5/2003 | Lechen | |
| 2005/0274547 | A1 * | 12/2005 | Fincher et al. | 175/57 |
| 2005/0279532 | A1 * | 12/2005 | Ballantyne et al. | 175/40 |

* cited by examiner

*Primary Examiner*—Hoang Dang
(74) *Attorney, Agent, or Firm*—Madan, Mossman & Sriram, P.C.

(57) ABSTRACT

A caliper tool used on a drilling tubular and having extensible members that remain decoupled with respect to the borehole wall during caliper measurements and while the extensible members are extended to allow movement in and through the borehole. A processor processes known and measured information to determine the size and shape of the borehole. Formation evaluation instruments may be included to allow formation evaluation substantially simultaneously with the caliper measurements.

21 Claims, 5 Drawing Sheets

APPARATUS AND METHOD FOR MECHANICAL CALIPER MEASUREMENTS DURING DRILLING AND LOGGING-WHILE-DRILLING OPERATIONS

CROSS REFERENCE TO RELATED APPLICATION

This application takes priority from U.S. Provisional Patent Application Ser. No. 60/648,486, filed on Jan. 31, 2005.

BACKGROUND OF THE INVENTION

1. Field of the Invention

This invention relates generally to drilling tools and in particular to an apparatus and method for determining the caliper of a well borehole while drilling, tripping or reaming.

2. Description of the Related Art

Many well logging and formation measurement applications require knowledge of the caliper of the borehole. Caliper measurements are typically performed using a wireline caliper tool run into the borehole after tripping the drill string. Caliper measurements while drilling are typically performed using ultrasonic techniques, because a rotating or longitudinally moving drill string poses problems not seen in wireling applications.

Accurate borehole size and geometry information is needed for a large range of applications. Data quality assessment and environmental corrections for formation evaluation ("FE") sensors require an understanding of the borehole size and geometry at the sensor location. In the wellbore completion process, one needs to know these borehole parameters for placing casing hardware, such as centralizers etc., and for determining an accurate cement volume. Determining regional directional stress from borehole elongation and breakout information and the assessment of suitability of drilling mud system in view of clay swelling or formation filter cake build-up also requires borehole measurement.

Caliper measurements are available from a number of different wireline devices, utilizing either mechanical arms in contact with the borehole wall or acoustic pulse echo sensors. The acoustic pulse-echo methods currently in use are limited in terms of hole size coverage, and in some cases the quality of pulse-echo measurements is degraded due to incompatible return fluid and/or poor formation conditions. With more and more deviated wells being logged with logging while drilling ("LWD") sensors, an accurate and real-time caliper measurement with a suitable dynamic range is needed.

Wireline tools are known in the art to measure the diameter, also known as the caliper, of a borehole to correct formation measurements that are sensitive to size or standoff. These corrections are necessary for accurate formation evaluation. U.S. Pat. No. 4,407,157 describes a technique for measuring a borehole caliper by incorporating a mechanical apparatus with extending contact arms that are forced against the sidewall of the borehole. This technique has practical limitations. In order to insert the apparatus in the borehole, the drillstring must be removed, resulting in additional cost and downtime for the driller. Such mechanical apparatus are also limited in the range of diameter measurement they provide. Furthermore, these mechanical wireline tools are not suited or a while-drilling environment, because the arms are coupled to the borehole wall when extended. If such a wireline tool were simply incorporated into a while-drilling system, the mechanical arm(s) will be damaged or will break. In some cases, such a tool might damage the borehole wall making any measurement invalid.

Wireline caliper tools are also time-consuming. The drill string must be tripped before running the wireline into the borehole. In view of the excessive time costs in drilling operations, these wireline tests can be quite expensive. Moreover, wireline tools cannot be effectively used in boreholes highly deviated from the vertical, which is often the case in directional drilling.

The typical caliper tools used while drilling today provide the ability to obtain caliper measurements in deviated boreholes. These tools, however suffer from other problems. Ultrasonic tools housed in a tool collar have difficulty when measuring through some borehole fluids. Depending upon the fluid chemistry, viscosity and the presence of particulates, the measurements may be inaccurate or impossible. Furthermore, these highly complex tools are quite expensive and prone to failure during operation in the harsh borehole environment.

There is, therefore, a need for a cost effective while-drilling tool capable of measuring the caliper of a borehole while maintaining high reliability.

SUMMARY OF THE INVENTION

The present invention addresses one or more of the above-identified problems found in conventional borehole caliper tools. The present invention overcomes some or all of the above-noted deficiencies by providing a tool for measuring the caliper of a borehole while drilling, while reaming and/or while tripping the tool from a borehole.

One aspect the present invention is an apparatus for determining a borehole dimension. The apparatus includes a tool conveyed in the borehole on an elongated tubular having a cutting tool for cutting into an earth formation. A selectively extensible member is coupled to the tool, the extensible member being extensible from the tool toward the borehole wall. A sensor is operatively associated with the extensible member and the extensible member remains substantially decoupled from the borehole wall while extended to allow the drilling tubular to move in the borehole during at least a portion of time during operation of the sensor. The sensor provides an output signal relating to one or more of i) a distance between a distal end of the extensible member and the borehole wall and ii) an amount of extension of the extensible member.

The extensible member may be elastically coupled to the tool, it may be pivotally coupled or it might achieve decoupling from the borehole wall by not contacting the borehole wall.

The extensible member can extend radially or angularly from the tool. The extensible member may include a decoupling device at a distal end of the extensible member. The decoupling device can have a shaped end to allow sliding contact and/or have a roller to allow rolling contact. The decoupling device may be an ultrasonic device, where the extensible member does not contact the borehole wall and the ultrasonic device is used to determine the small distance between the extensible member and the borehole wall.

The cutting tool may include either or both of a drill bit and a reaming bit. In one aspect, the invention further includes one or more formation evaluation instruments used in conjunction with the extensible members and sensor. The formation evaluation instrument evaluates a formation parameter while the tool is operated to determine the borehole dimension at substantially the same time as the formation parameter is evaluated.

In another aspect of the invention a method for determining a borehole dimension is provided. The method includes conveying a tool through the borehole on an elongated tubular having a cutting tool for cutting into an earth formation, extending a selectively extensible member from the tool toward the borehole wall, generating a signal relating to one or more of i) a distance between a distal end of the extensible member and the borehole wall and ii) an amount of extension of the extensible member using a sensor operatively associated with the extensible member; and maintaining the extensible member substantially decoupled from the borehole wall while extended to allow the drilling tubular to move in the borehole during at least a portion of time during operation of the sensor.

Another aspect of the invention is a system for determining a borehole dimension during drilling operations. The system includes a drilling apparatus comprising a drilling tubular having a drill bit for drilling the borehole. A tool is conveyed in the borehole on the drilling tubular and a selectively extensible member is coupled to the tool, the extensible member being extensible from the tool toward the borehole wall. A sensor is operatively associated with the extensible member, wherein the extensible member remains substantially decoupled from the borehole wall while extended to allow the drilling tubular to move in the borehole during at least a portion of time during operation of the sensor, the sensor providing an output signal relating to one or more of i) a distance between a distal end of the extensible member and the borehole wall and ii) an amount of extension of the extensible member. A processor processes the output signal, and the processed output signal is indicative of the borehole dimension.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
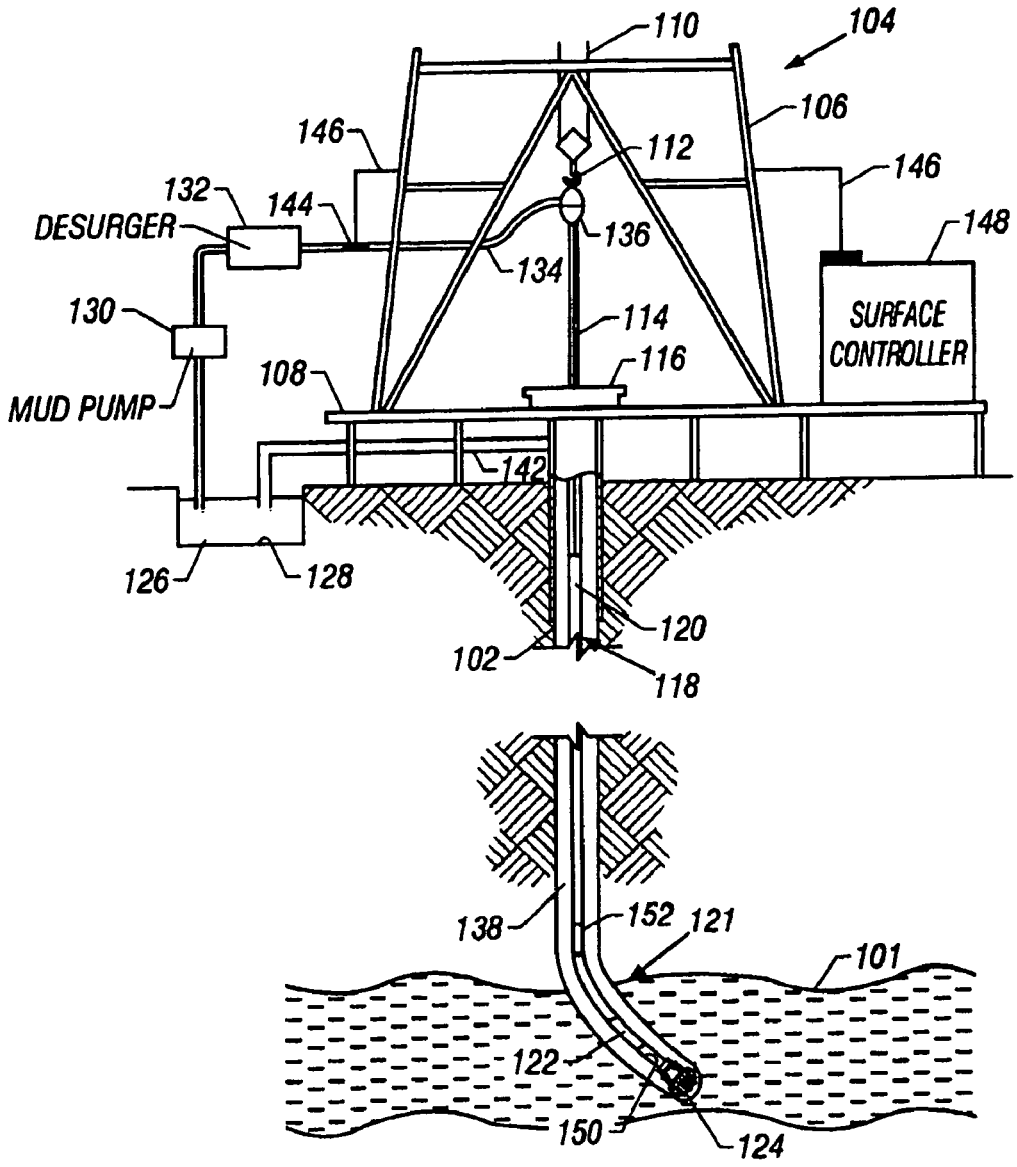
FIG. 1 is an elevation view of a simultaneous drilling and logging system that incorporates an embodiment of the present invention.

FIG. 1 is an elevation view of a simultaneous drilling and logging system that incorporates an embodiment of the present invention. A well borehole 102 is drilled into the earth under control of surface equipment including a rotary drilling rig 104. In accordance with a conventional arrangement, rig 104 includes a derrick 106, derrick floor 108, draw works 110, hook 112, kelly joint 114, rotary table 116, and drill string 118. The drill string 118 includes drill pipe 120 secured to the lower end of kelly joint 114 and to the upper end of a section comprising a plurality of drill collars. The drill collars include not separately shown drill collars such as an upper drill collar, an intermediate drill collar, and a lower drill collar bottom hole assembly (BHA) 121 immediately below the intermediate sub. The lower end of the BHA 121 carries a downhole tool 122 of the present invention and a drill bit 124.

Drilling mud 126 is circulated from a mud pit 128 through a mud pump 130, past a desurger 132, through a mud supply line 134, and into a swivel 136. The drilling mud 126 flows down through the kelly joint 114 and a longitudinal central bore in the drill string, and through jets (not shown) in the lower face of the drill bit. Borehole fluid 138 containing drilling mud, cuttings and formation fluid flows back up through the annular space between the outer surface of the drill string and the inner surface of the borehole to be circulated to the surface where it is returned to the mud pit through a mud return line 142. A shaker screen (not shown) separates formation cuttings from the drilling mud before the mud is returned to the mud pit.

The system in FIG. 1 may use any number of known communication techniques to communicate with the surface. In one embodiment, the system uses mud pulse telemetry techniques to communicate data from down hole to the surface during drilling operations. To receive data at the surface, there is a transducer 144 in a mud supply line 132. This transducer generates electrical signals in response to drilling mud pressure variations, and a surface conductor 146 transmits the electrical signals to a surface controller 148.

If applicable, the drill string 118 can have a downhole drill motor 150 for rotating the drill bit 124. Incorporated in the drill string 118 above the drill bit 124 is the downhole tool 122 of the present invention, which will be described in greater detail hereinafter. A telemetry system 152 is located in a suitable location on the drill string 118 such as above the tool 122. The telemetry system 152 is used to receive commands from, and send data to, the surface via the mud-pulse telemetry described above.

Figure 2:
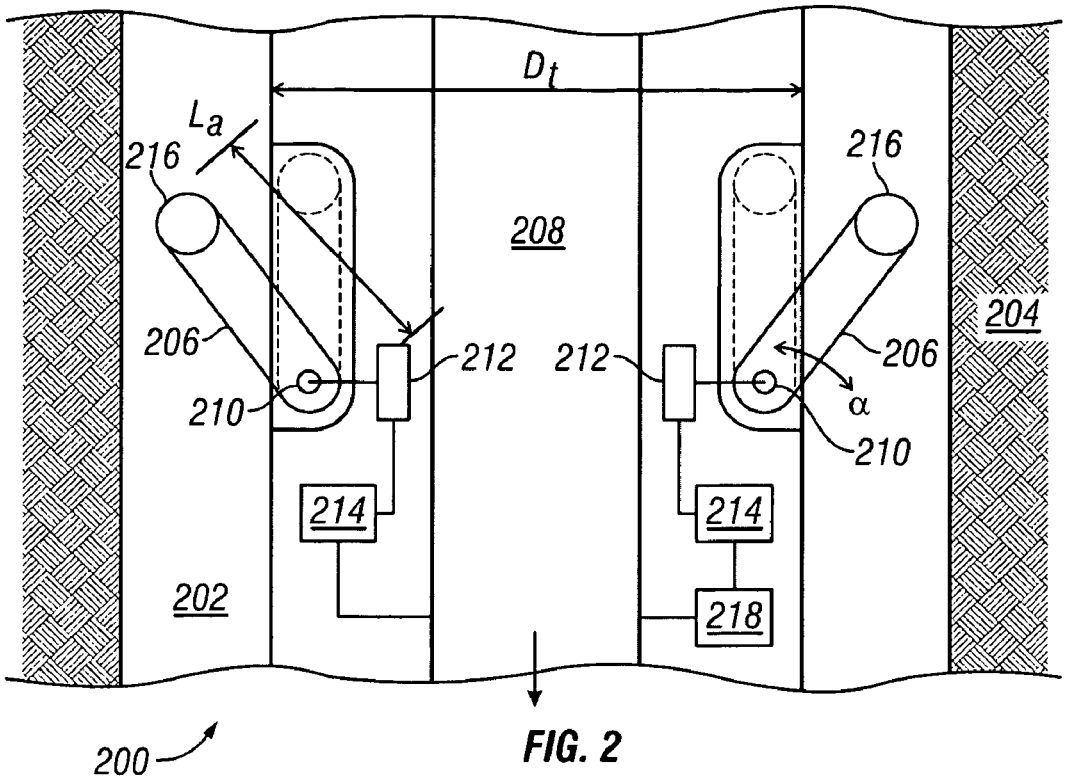
FIG. 2 shows a caliper tool according to one embodiment of the present invention in cross section.

FIG. 2 shows a caliper tool according to the present invention in cross section. Shown is a tool 200 running through a well borehole 202 drilled through a formation 204. The tool 200 includes one or more extensible members such as ribs or arms 206 used to measure and determine the size and shape of the borehole 202.

Each arm 206 is coupled to the tool 200 using a non-binding point coupling such as a pivot pin 210. It is not necessary that the coupling be of a pin type. A threaded insert or other non-binding coupling will work so long as the arm 206 is substantially free to move at the coupling point. In this manner, the arm 206 is essentially decoupled from the borehole wall. This decoupling allows the tool to move through the borehole during measurements without binding or sticking.

Those skilled in the art would recognize that there are numerous mechanisms available to extend an arm. One such mechanism is a controllable latch and biasing member such as a spring. Another mechanism could be a motor or hydraulic piston.

For the purposes of the present invention, the extended member should be decoupled from the borehole wall during extension and at full extension to ensure the ability to move the tool axially and/or rotationally through the borehole during measurements. The extension device should allow movement back and forth during measurement, because the borehole wall is likely to be irregular in shape. For the purposes of the present application, the phrase "decoupled with respect to the borehole wall" should be read to encompass any such mechanism that allows the member to move through the borehole, axially and/or rotationally, without being in fixed contact with the borehole wall. Contact with the borehole wall is within the scope of the phrase so long as the contact is slidable or rolling contact.

In one embodiment, the arm 206 is a releasable arm biased to extend when released. The biasing device may be a spring or the like. If a releasable biased arm is used, then a retraction mechanism can be incorporated to retract the arm. The retraction mechanism can be hydraulic or electromechanical such as a motor.

The embodiment shown in FIG. 2 includes a motor device 212 for extending the arm 206. The motor 212 may be any motor suitable for downhole operation. For example without limitation, the motor 212 may be an electrical step motor or a ball and screw electromechanical motor. The motor may be hydraulic or a small turbine driven by drilling fluid diverted from the tool central bore 208. A hydraulic motor might also use self contained fluid using an electric motor controlling a pump.

When extended, the arm 206 remains decoupled with respect to the borehole wall using a decoupling device 216. The decoupling device 216 might be a wheel-type roller or a ball-socket roller. A ball-socket roller is useful in allowing both rotational and axial movement without damage or sticking on the borehole wall. As will be discussed later with respect to the embodiment shown in FIG. 4, the decoupling device 216 might also be an ultrasonic device measuring a small distance between the end of the arm and the borehole wall. The small distance keeps the arm decoupled with respect to the borehole wall.

A sensor 214 is used to measure an amount of extension required to bring the arm 206 into contact with or close proximity to the borehole wall. In the embodiment shown here, the arm 206 has a known length $L_a$ and the tool 200 has a known diameter $D_t$. The extended arm forms an angle $\alpha$ parallel to a longitudinal axis of the tool 200. The angle $\alpha$ can be determined using an output of the sensor 214, which might measure rotations or steps of a motor extending the arm 206. A processor 218 can then process the sensor output downhole to determine $\alpha$. The processor 218 is shown downhole, but the processor might be implemented in alternative embodiments completely uphole or partially uphole and partially downhole depending on the needs of the particular drilling system.

With known $L_a$, $D_t$ and $\alpha$, it is then a straight forward calculation using the processor to determine the borehole size at a particular location. The caliper tool 200 is then moved in the borehole to determine the size and shape of the borehole. The present invention includes rotating the tool and moving the tool axially in the borehole, which provides substantially complete size and shape information about the borehole in an area of interest.

Figure 3:
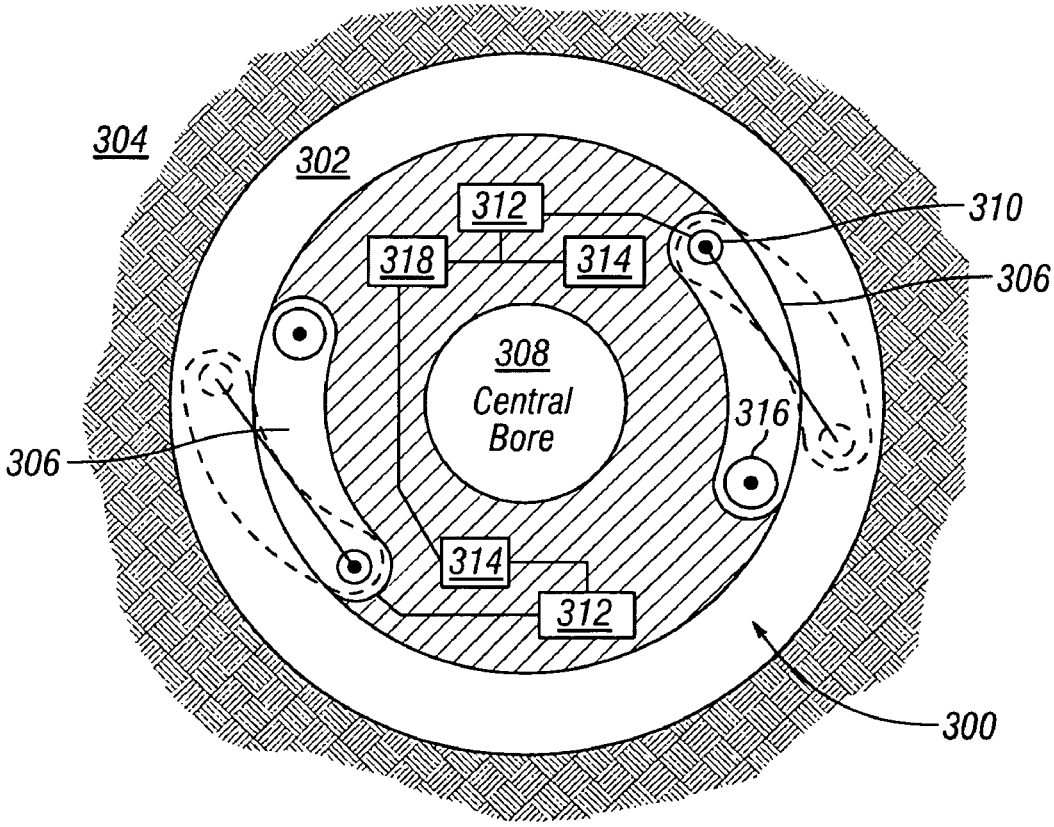
FIG. 3 shows an embodiment of the present invention having two extensible arms extending in a plane perpendicular to the tool long axis.

FIG. 3 shows an embodiment of the present invention having two extensible arms 306 extending in a plane perpendicular to the tool long axis. In this manner the arms are well suited for remaining decoupled with respect to the borehole wall when the tool 300 is rotated.

Shown is a tool 300 running through a well borehole 302 drilled through a formation 304. The tool 300 includes one or more extensible members such as ribs or arms 306 used to measure and determine the size and shape of the borehole 302. The arms 306 are curved in this embodiment to present a smooth tool perimeter when the arms 306 are in a retracted position. The operation and mechanisms of the embodiment shown in FIG. 3 are substantially similar to those of FIG. 2, except that the arms 306 move in a plane normal to the tool z-axis.

Each arm 306 is coupled to the tool 300 using a non-binding point coupling such as a pivot pin 310. It is not necessary that the coupling be of a pin type. A threaded insert or other non-binding coupling will work so long as the arm 306 is substantially free to move at the coupling point. In this manner, the arm 306 is essentially decoupled from the borehole wall. This decoupling allows the tool to move through the borehole during measurements without binding or sticking. Contact with the borehole wall is permitted so long as the contact is slidable or rolling contact.

In one embodiment, the arm 306 is a releasable arm biased to extend when released. The biasing device may be a spring or the like. If a releasable biased arm is used, then a retraction mechanism can be incorporated to retract the arm. The retraction mechanism can be hydraulic or electromechanical such as a motor.

The embodiment shown in FIG. 3 includes a motor device 312 for extending the arm 306. The motor 312 may be any motor suitable for downhole operation. For example without limitation, the motor 312 may be an electrical step motor or a ball and screw electromechanical motor. The motor may be hydraulic or a small turbine driven by drilling fluid diverted from the tool central bore 308. A hydraulic motor might also use self contained fluid using an electric motor controlling a pump.

When extended, the arm 306 remains decoupled with respect to the borehole wall using a decoupling device 316. The decoupling device 316 might be a wheel-type roller or a ball-socket roller. A ball-socket roller is useful in allowing both rotational and axial movement without damage or sticking on the borehole wall. The decoupling device 316 might also be an ultrasonic device measuring a small distance between the end of the arm and the borehole wall. The small distance keeps the arm decoupled with respect to the borehole wall.

A sensor 314 is used to measure an amount of extension required to bring the arm 306 into contact with or close proximity to the borehole wall. In the embodiment shown here, the arm 306 has a known length $L_a$ and the tool 300 has a known diameter $D_t$. The extended arm forms an angle $\alpha$ with respect to the arm retracted position. The angle $\alpha$ can be determined using an output of the sensor 314, which might measure rotations or steps of a motor extending the arm 306. A processor 318 can then process the sensor output downhole to determine $\alpha$. The processor 318 is shown downhole, but the processor might be implemented in alternative embodiments completely uphole or partially uphole and partially downhole depending on the needs of the particular drilling system.

With known $L_a$, $D_t$ and $\alpha$, it is then a straight forward calculation using the processor to determine the borehole size at a particular location. The caliper tool 300 is then moved in the borehole to determine the size and shape of the borehole. As with the embodiment of FIG. 2, this embodiment contemplates rotating the tool and moving the tool axially in the borehole, which provides substantially complete size and shape information about the borehole in an area of interest.

Figure 4:
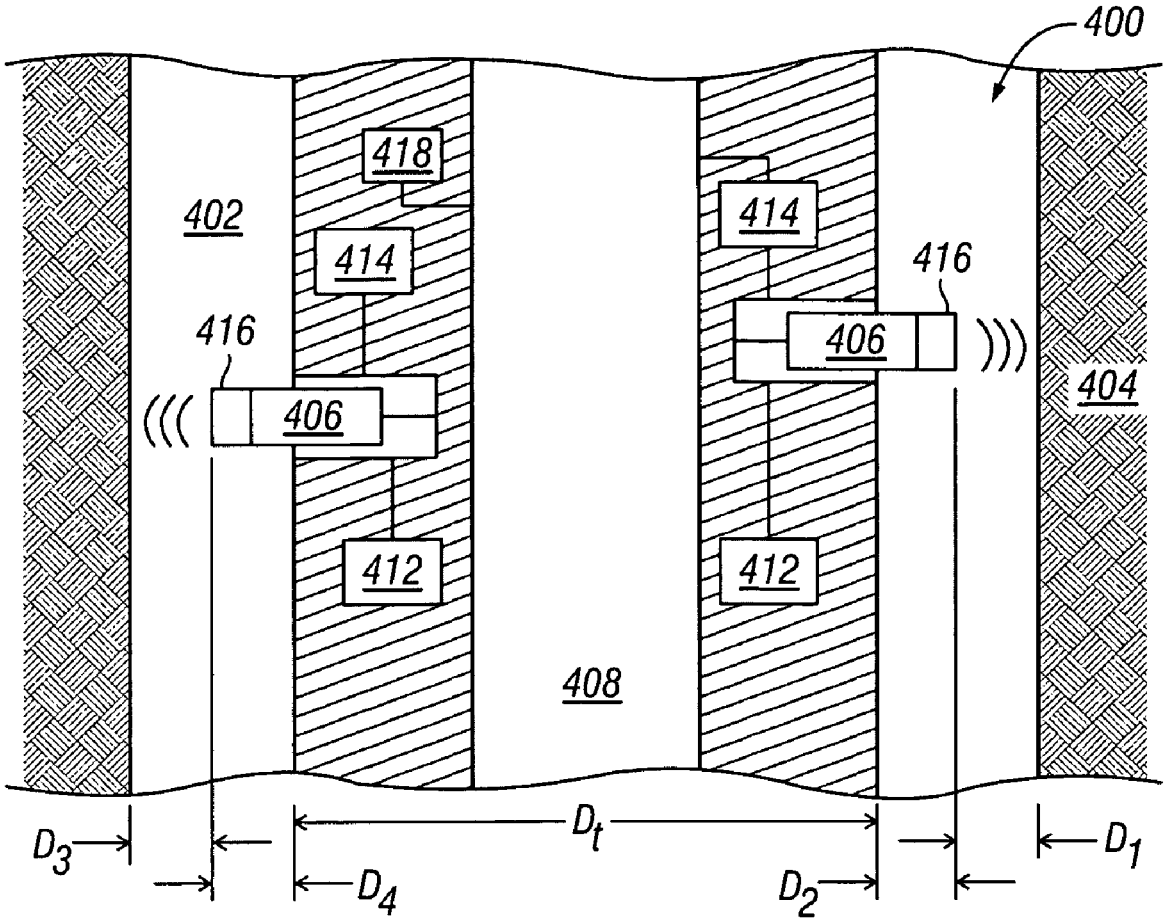
FIG. 4 is another embodiment of the present invention, wherein the extensible arms are extensible pistons in conjunction with acoustic sensors to help ensure the tool remains decoupled with respect to the borehole wall during use of the tool.

FIG. 4 is another embodiment of the present invention, wherein the extensible arms are extensible pistons 406 in conjunction with acoustic sensors to help ensure the tool 400 remains decoupled with respect to the borehole wall during use of the tool 400. Using an extensible arm or piston in conjunction with an ultrasonic device overcomes the limitations found in purely ultrasonic tools, namely the ultrasonic sensor is much less affected by larger hole size, poor borehole wall conditions and incompatible return fluid. Heretofore, those skilled in the art have not recognized that extending an ultrasonic sensor toward the borehole wall will overcome such limitations.

Shown is the tool 400 disposed in a well borehole 402. The tool 400 includes an axial bore 408 for allowing pressurized drilling fluid to pass through the tool 400. The tool 400 includes extensible members such as pistons 406. These pistons are selectively extended and controlled using a motor device 412. The motor 412 may be any motor suitable for downhole operation. For example without limitation, the motor 412 may be an electrical step motor or a ball and screw electromechanical motor. The motor may be hydraulic or a small turbine driven by drilling fluid diverted from the tool central bore 408. A hydraulic motor might also use self contained fluid using an electric motor controlling a pump. The pistons might be directly hydraulically operated using controlled valves and pressurized fluid such as drilling fluid or hydraulic fluid.

When extended, each piston 406 remains decoupled with respect to the borehole wall using a decoupling device 416. The decoupling device 416 shown is an ultrasonic pulse-echo sensor measuring a small distance $D_3$ between the a distal end of the piston and the borehole wall. The small distance keeps the piston decoupled with respect to the borehole wall.

A sensor 414 is used to measure an amount of extension required to bring the piston 406 into close proximity with the borehole wall. In the embodiment shown here, the tool diameter $D_t$ is known. The distance between each piston distal end and the borehole wall indicated respectively by $D_1$ and $D_3$ is determined using the ultrasonic sensor 416. The distance that each piston 406 is extended is indicated respectively by $D_2$ and $D_4$ and is determined by sensors 414. A processor 418 can then process the output of all sensors downhole to determine the borehole size at any given point. Moving the tool while sensing provides data that can be processed to determine both size and shape of the borehole. The processor 418 is shown downhole, but the processor might be implemented in alternative embodiments completely uphole or partially uphole and partially downhole depending on the needs of the particular drilling system. As with the embodiments of FIGS. 2 and 3, this embodiment contemplates rotating the tool and moving the tool axially in the borehole, which provides substantially complete size and shape information about the borehole in an area of interest.

Variations of a caliper tool according to the present invention are possible without departing from the scope of the invention. FIGS. 5-10 show exemplary and non-limiting variations of the present invention. All control, sensing and processing aspects of these embodiments are substantially as described above and shown in FIGS. 2-4. As such, these aspects are not again shown here or described with respect to FIGS. 5-10. Suffice it to say that those skilled in the art having the benefit of the descriptions and figures herein above could readily incorporate the various components into these embodiments.

Figure 5:
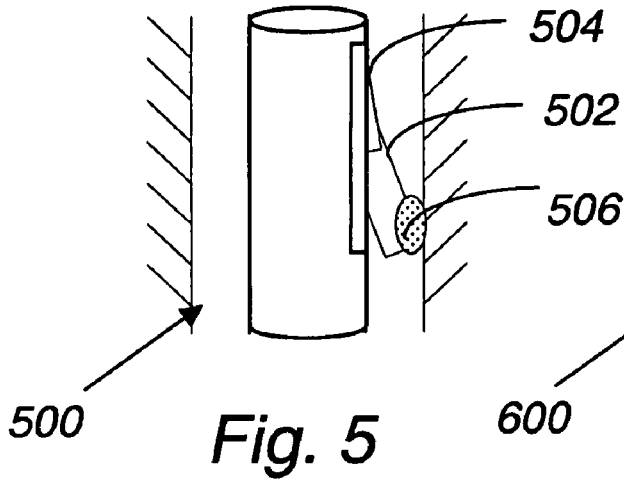
FIG. 5 shows a tool according to one embodiment of the invention having an extensible member elastically coupled to the tool.

FIG. 5 shows a tool 500 having an extensible member such as an arm 502. An elastic coupling 504 couples the arm 502 to the tool housing. The elastic coupling 504 can be any elastic coupling that allows the arm 502 to remain decoupled with respect to the borehole wall. The coupling material may be an elastomeric material, reinforced rubber or a metal having a spring-like response. The angle of the arm is measured as described above and the decoupling may be enhanced by a decoupling device 506 as described above.

Figure 6:
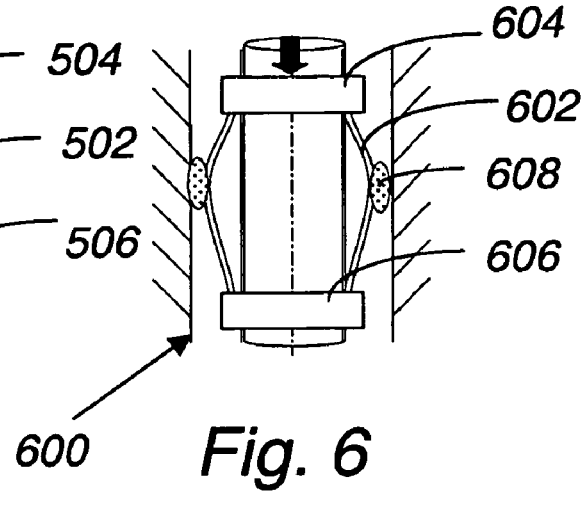
FIG. 6 is another embodiment of the invention schematically showing the extensible member as bow springs.

FIG. 6 is another embodiment of the invention shown in schematic. The tool 600 is disposed in a borehole adjacent a formation. The tool 600 includes an upper collar 604 and a lower collar 606. Between the upper collar and the lower collar are two bow springs 602. The bow springs 602 extend outward from the tool 600 when the collars are forced toward one another. The collars (one or both) are actuated by a motor or other drive mechanism as described above. Each bow spring might include a decoupling device 608 as described above, or the springs might be shaped for sliding contact with the borehole wall.

Figure 7:
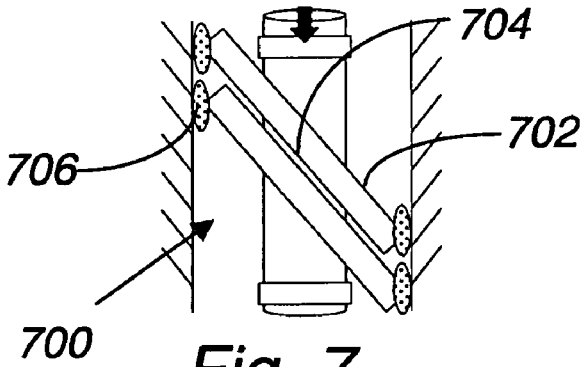
FIG. 7 shows another embodiment of the invention using one or more wobble rings.

FIG. 7 shows another embodiment of a tool 700 according to the invention using one or more wobble rings 702. The wobble rings 702 are extended by rotating the oval rings about a pivot 704 along the tool axis. Once extended, the rings remain decoupled with respect to the borehole wall by a "wobble" action initiated whenever a point on a ring encounters resistance while moving through the borehole. The ring shape allows rotational movement of the tool 700 without binding in the borehole. The decoupling may be enhanced by using a decoupling device 706 as described above.

Figure 8:
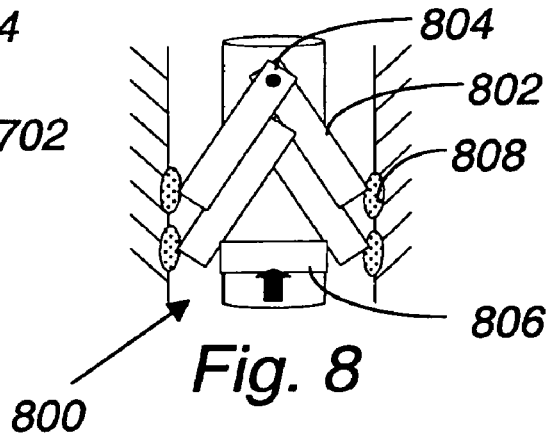
FIG. 8 shows another embodiment of the present invention using a plurality of extensible arms arranged in an overlapping fashion.

FIG. 8 shows another embodiment of a tool 800 according to the present invention using a plurality of extensible arms 802 arranged in an overlapping fashion. This arrangement of arms is coupled to the tool on a pivot 804 and is activated to extend outwardly from the tool 800 by a drive collar 806. The drive collar can be actuated by a motor, either electric or hydraulic as described above. The angle of each arm is measured as described above and the decoupling may be enhanced by a decoupling device 808 as described above.

Figure 9:
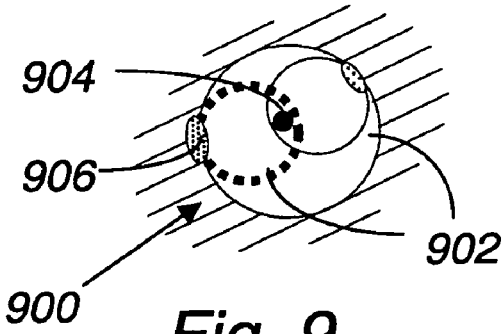
FIG. 9 shows another embodiment of the invention using eccentric rings extensible from the tool.

FIG. 9 shows another embodiment of a tool 900 according to the present invention using eccentric rings 902 to extend from the tool 900. The rings are pivotally coupled to the tool at a pivot 904 and axially juxtaposed to one another. The angle of pivot can be measured as described above and the decoupling may be enhanced by a decoupling device 906 as described above.

Figure 10:
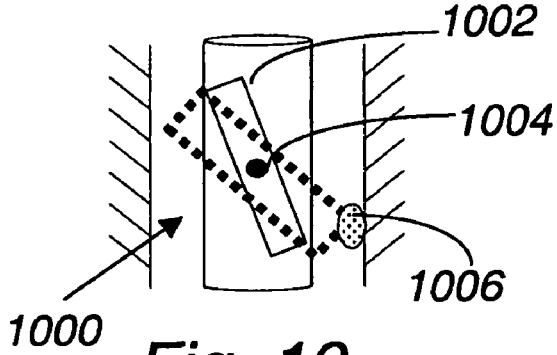
FIG. 10 shows another embodiment using a torsion bar pivotally mounted on the tool at a pivot.

FIG. 10 shows another embodiment of a tool 1000 according to the present invention using a torsion bar 1002 pivotally mounted on the tool at a pivot 1004. The torsion arm extension may be controlled by a motor device as describe above. The angle of the arm is measured and processed along with all known constants as described above. The decoupling may be enhanced by a decoupling device 1006 as described above.

Figure 11A:
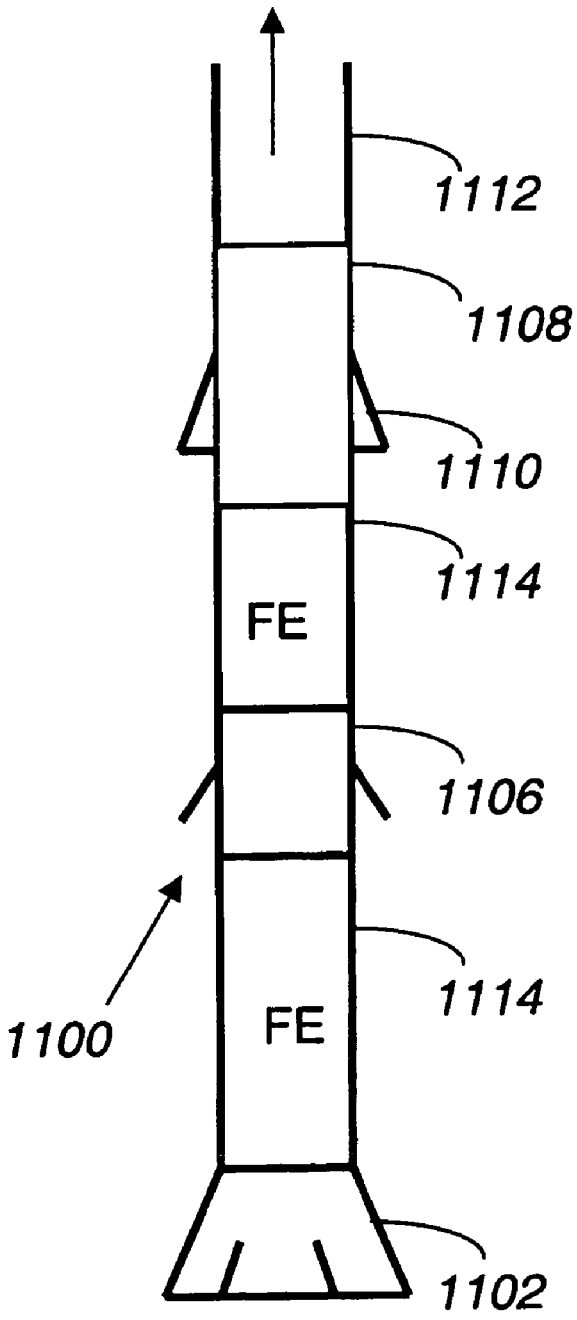
FIGS. 11A-11B show two embodiments where a caliper tool according to the invention is used while reaming, while drilling and/or while determining various formation parameters using formation evaluation instruments.
Figure 11B:
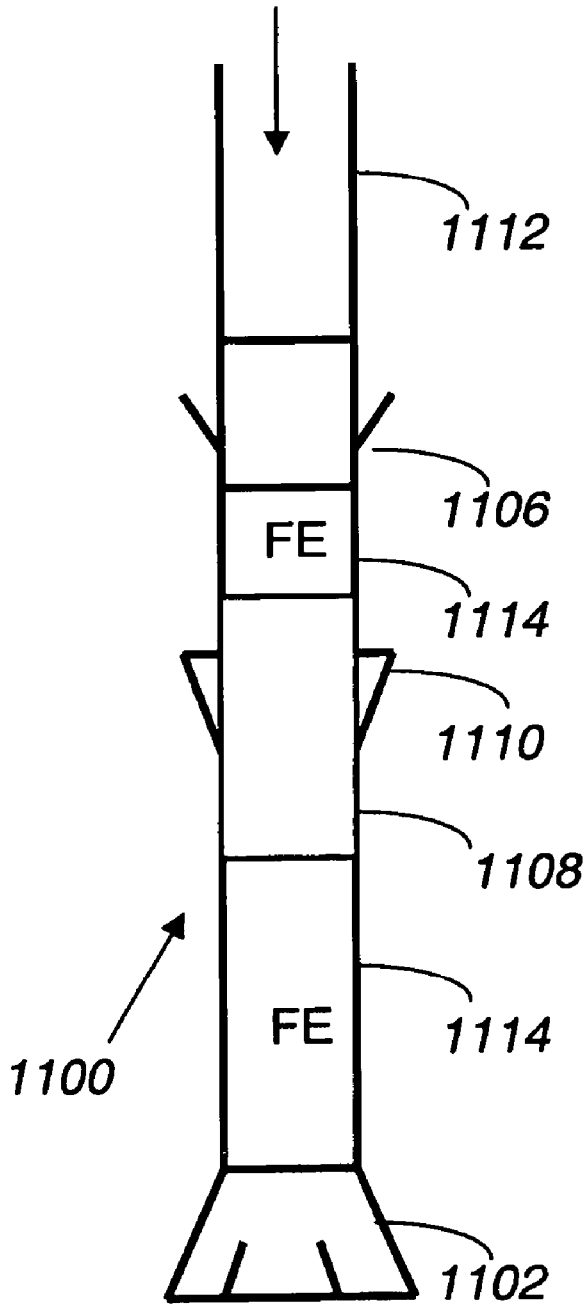

Referring to FIGS. 11A-11B, another aspect of the present invention is a caliper tool used while reaming. Those skilled in the art would recognize various configurations of reaming tools. FIG. 11A shows a BHA 1100 including a drill bit 1102. The BHA 1100 is carried into the borehole on a drill string 1112. A caliper tool 1106 is positioned on the BHA 1100 above the drill bit 1102. The caliper tool may be according to any of the previously described tools shown if FIGS. 2-10.

Therefore, the caliper tool is only shown schematically here and will not be described in detail.

A reaming collar 1108 is positioned on the BHA above the caliper tool 1106. The reaming collar includes one or more extensible cutting bits 1104 for reaming the borehole as the BHA is being tripped from the borehole. The reaming collar includes a set of reaming bits 1110 extensible from the collar 1108. The bits are activated, for example, by hydraulic force using drilling fluid flowing within the tool. Once activated, the reaming bits are extended to make cutting contact with the borehole wall. Reaming collars are known. Therefore, the reaming collar 1108 is only shown schematically and will not be described in further detail here.

In some drilling operations, the borehole is reamed while the drill string is being tripped from the borehole as shown in FIG. 11A. In the embodiment shown, the caliper tool is positioned on the BHA below the reaming collar 1108 to allow caliper measurements while the drill string is tripped from the borehole. The caliper measurements may be accomplished while the reaming collar is being used to ream the borehole above the caliper tool. It is likewise contemplated in this embodiment that the caliper measurements are made while tripping, but were the borehole is not being reamed using the reaming collar. It is likewise clear from the embodiment shown that the caliper tool can be used while drilling the borehole where the reaming collar is not being used.

Sometimes the caliper measurement is made to ensure the reaming tool is operating properly. As stated in the background section herein above, caliper measurements are often used in conjunction with formation evaluation measurements to provide data correction where borehole size is a factor. Therefore, an optional feature of the present invention is the addition of formation evaluation ("FE") tools 1114. The FE tools may include any number of useful formation evaluation instruments. These instruments may be nuclear magnetic resonance ("NMR"), resistivity instruments, borehole pressure tools, light-based reflectance tools or the like. For the purposes of the present invention, the FE tool may be any tool where the borehole size affects the FE tool output or the review of such tool output.

The FE tools 1114 are shown on either side of the caliper tool 1106. The actual position of the FE tool 1114 may likewise be in any other useful position on the BHA 1100 or along the drill string 1112.

FIG. 11B is substantially similar to FIG. 11A, except that the configuration of 11B is a reaming-while-drilling configuration. The reference numerals of FIG. 11A are used in 11B to indicate that the components described below may be substantially similar to the components shown in FIG. 11A and described above even if the components are located elsewhere on the BHA. In the embodiment shown, FE measurements may be taken substantially simultaneously with the caliper measurements, during the reaming process, or during the drilling process. Likewise, FE measurements may be taken during the combination of caliper measurements and drilling.

FIG. 11B shows a BHA 1100 including a drill bit 1102. The BHA 1100 is carried into the borehole on a drill string 1112. A caliper tool 1106 is positioned on the BHA 1100 above the drill bit 1102. The caliper tool may be according to any of the previously described tools shown if FIGS. 2-10. Therefore, the caliper tool is only shown schematically here and will not be described in detail.

A reaming collar 1108 is positioned on the BHA below the caliper tool 1106. The reaming collar includes one or more extensible cutting bits 1104 for reaming the borehole as the BHA is advancing into the borehole and while the drill bit 1102 is further drilling the borehole. The reaming collar includes a set of reaming bits 1110 extensible from the collar 1108. The bits are activated, for example, by hydraulic force using drilling fluid flowing within the tool. Once activated, the reaming bits are extended to make cutting contact with the borehole wall. Reaming collars are known. Therefore, the reaming collar 1108 is only shown schematically and will not be described in further detail here.

In some drilling operations, the borehole is reamed while the borehole is being drilled as shown in FIG. 11B. In the embodiment shown, the caliper tool is positioned on the BHA above the reaming collar 1108 to allow caliper measurements while the drill string is being used to drill the borehole. The caliper measurements may be accomplished while the reaming collar is being used to ream the borehole below the caliper tool. It is likewise contemplated in this embodiment that the caliper measurements are made while drilling, but were the borehole is not being reamed using the reaming collar. It is clear from the embodiment shown that the caliper measurements might also be made while tripping where neither the drilling bit nor the reaming collar is in use.

As stated above caliper measurements are sometimes made to ensure the reaming tool is operating properly and that caliper measurements are also often used in conjunction with formation evaluation measurements to provide data correction where borehole size is a factor. The FE tools 1114 are shown in this embodiment below the caliper tool 1106 and on either side of the reaming collar 1108. And as stated above, the actual position of the FE tool 1114 may likewise be in any other useful position on the BHA 1100 or along the drill string 1112. In the embodiment shown, FE measurements may be taken substantially simultaneously with the caliper measurements, during the reaming process, or during the drilling process. Likewise, FE measurements may be taken during any combination of caliper, reaming and/or drilling.

The foregoing description is directed to particular embodiments of the present invention for the purpose of illustration and explanation. It will be apparent, however, to one skilled in the art that many modifications and changes to the embodiment set forth above are possible without departing from the scope of the invention and the following claims.

What is claimed is:

1. An apparatus for determining a borehole dimension comprising:

a) a tool conveyed in the borehole on an elongated tubular having a cutting tool for cutting into an earth formation;

b) a selectively extensible member coupled to the tool, the extensible member being extensible from the tool toward the borehole wall; and c) a sensor operatively associated with the extensible member, wherein the extensible member remains substantially decoupled from the borehole wall while extended to allow the tubular to move in the borehole during at least a portion of time during operation of the sensor, the sensor providing an output signal relating to one or more of (i) a distance between a distal end of the extensible member and the borehole wall, and (ii) an amount of extension of the extensible member.

2. The apparatus of claim 1, wherein the extensible member comprises an arm member elastically coupled to the tool.

3. The apparatus of claim 1, wherein the extensible member comprises a first end and a second end, the extensible member pivotally mounted on the tool at the first end to allow the second end to extend angularly from a z-axis of the tool.

4. The apparatus of claim 1, wherein the extensible member comprises a first end and a second end, the extensible member pivotally mounted on the tool at the first end to allow the second end to extend angularly in a plane normal to a z-axis of the tool.

5. The apparatus of claim 1, wherein the extensible member comprises a curved arm having a first end and a second end, the curved arm being pivotally mounted on the tool at the first end to allow the second end to extend from the tool, the second end having a rolling member mounted thereon to inhibit tool coupling with respect to the borehole wall.

6. The apparatus of claim 1, wherein the extensible member comprises a piston extending in a radial direction from a z-axis of the tool.

7. The apparatus of claim 6, wherein the piston comprises a plurality of pistons disposed about a periphery of the tool.

8. The apparatus of claim 1, wherein the sensor comprises a first sensor and a second sensor, the first sensor determining an amount of extension of the extensible member, the second sensor operatively associated with a distal end of the extensible member, the extensible member extending to traverse only a portion of the distance between the tool and the borehole wall, the second sensor being used to determine a remaining distance between the extensible member distal end and the borehole wall.

9. The apparatus of claim 1, wherein the extensible member is selected from a group consisting of i) an oval wobble ring, ii) a buckle spring, iii) a torsion rib, and iv) an eccentric ring rotated about the borehole.

10. The apparatus of claim 1, wherein the cutting tool comprises a drill bit at a distal end of the elongated tubular.

11. The apparatus of claim 1, wherein the cutting tool comprises a reaming bit.

12. The apparatus of claim 1, wherein the cutting tool comprises a drill bit at a distal end of the elongated tubular and a reaming bit located on the elongated tubular above the drill bit.

13. The apparatus of claim 1, wherein the extensible member is extended during one or more of i) while tripping the drilling tubular from the borehole, ii) while drilling the borehole, and iii) while reaming the borehole.

14. The apparatus of claim 1, wherein the tool is located on the tubular near a formation evaluation instrument evaluating a formation parameter while the tool is operated to determine the borehole dimension at substantially the same time as the formation parameter is evaluated.

15. A method for determining a borehole dimension comprising:

a) conveying a tool through the borehole on a tubular having a cutting tool for cutting into an earth formation;

b) extending a selectively extensible member from the tool toward the borehole wall;

c) generating a signal relating to one or more of i) a distance between a distal end of the extensible member and the borehole wall and ii) an amount of extension of the extensible member using a sensor operatively associated with the extensible member; and d) maintaining the extensible member substantially decoupled from the borehole wall while extended to allow the tubular to move in the borehole during at least a portion of time during operation of the sensor.

16. The method of claim 15, wherein the extensible member comprises a first end and a second end, the extensible member pivotally mounted on the tool at the first end, and extending the extensible member comprises extending the second end angularly in a plane normal to a z-axis of the tool.

17. The method of claim 15, wherein the sensor comprises a first sensor and a second sensor operatively associated with a distal end of the extensible member, wherein extending the extensible member comprises extending the extensible member to traverse only a portion of the distance between the tool and the borehole wall, the method further comprising:

i) determining an amount of extension of the extensible member using the first sensor; and ii) determining a remaining distance between the extensible member distal end and the borehole wall using the second sensor.

18. The method of claim 15, wherein the extensible member is extended during one or more of i) while tripping the elongated tubular from the borehole, ii) while drilling the borehole, and iii) while reaming the borehole.

19. A system for determining a borehole dimension during drilling operations, the system comprising:

a) a drilling apparatus comprising a drilling tubular having a drill bit for drilling the borehole;

b) a tool conveyed in the borehole on the drilling tubular;

c) a selectively extensible member coupled to the tool, the extensible member being extensible from the tool toward the borehole wall;

d) a sensor operatively associated with the extensible member, wherein the extensible member remains substantially decoupled from the borehole wall while extended to allow the drilling tubular to move in the borehole during at least a portion of time during operation of the sensor, the sensor providing an output signal relating to one or more of i) a distance between a distal end of the extensible member and the borehole wall and ii) an amount of extension of the extensible member; and e) a processor processing the output signal, the processed output signal being indicative of the borehole dimension.

20. The system of claim 19, wherein the extensible member is extended during one or more of i) while tripping the drilling tubular from the borehole, ii) while drilling the borehole, and iii) while reaming the borehole.

21. The system of claim 19, wherein the tool is located on the drilling tubular near a formation evaluation instrument evaluating a formation parameter while the tool is operated to determine the borehole dimension at substantially the same time as the formation parameter is evaluated.

* * * * *